United States Patent [19]

Matsuyoshi et al.

[11] 4,111,319

[45] Sep. 5, 1978

[54] APPARATUS FOR LOADING AND UNLOADING A WORKING MACHINE TO AND FROM MAIN EQUIPMENT

[75] Inventors: Hideaki Matsuyoshi; Kazushige Mori; Yukio Shimono, all of Sakai, Japan

[73] Assignee: Kubota, Ltd., Osaka, Japan

[21] Appl. No.: 808,522

[22] Filed: Jun. 21, 1977

[51] Int. Cl.[2] ..... E02F 3/72

[52] U.S. Cl. ..... 214/131 A; 214/145 A; 214/DIG. 11; 280/420; 280/460 R; 403/95; 403/102

[58] Field of Search ..... 214/131 A, 138 R, 138 C, 214/145 A, DIG. 11; 280/420, 421, 422, 456 R, 456 A, 460 R, 460 A, 461 R, 461 A, 490 R; 172/272, 273, 274; 403/92, 95, 102, 330

[56] References Cited

U.S. PATENT DOCUMENTS

| | | | |
|---|---|---|---|
| 2,619,888 | 12/1952 | Young et al. | 280/421 |
| 3,155,250 | 11/1964 | French et al. | 214/138 C |
| 3,220,487 | 11/1965 | Pilch | 172/274 |
| 3,608,930 | 9/1971 | Morcieau et al. | 172/274 X |
| 3,614,134 | 10/1971 | Morcieau et al. | 280/456 R |
| 3,627,155 | 12/1971 | Van Der Zyl | 214/138 R |
| 3,788,674 | 1/1974 | Casey | 214/138 C X |
| 3,922,006 | 11/1975 | Borges | 280/490 R |
| 4,043,470 | 8/1977 | Pilch | 214/145 A |

*Primary Examiner*—L. J. Paperner

*Attorney, Agent, or Firm*—Haseltine, Lake & Waters

[57] ABSTRACT

Apparatus for loading and unloading a working machine to and from main equipment, comprising a pair of upper and lower supporting members disposed at main equipment, a pair of upper and lower fixtures disposed at the working machine so as to correspond to said pair of supporting members respectively, engagement projections and engagement hooks respectively disposed at said upper and lower supporting members, latch arms and fitting pins respectively disposed at said upper and lower fixtures, wedge means disposed between said upper supporting member and said upper fixture, and fixing means for fixing said wedge means, whereby the working machine may be readily and securely loaded to main equipment by wedging action of said wedge means, and may also be readily unloaded from main equipment.

4 Claims, 6 Drawing Figures

APPARATUS FOR LOADING AND UNLOADING A WORKING MACHINE TO AND FROM MAIN EQUIPMENT

BACKGROUND OF THE INVENTION

The present invention relates to an apparatus which loads and unloads various kinds of working machine to and from main equipment, particularly construction equipment.

A working machine has conventionally been loaded to or from construction equipment or the like, in such a way that a pair of supporting members are disposed at the upper and lower portions of main equipment and a pair of fixtures corresponding to said pair of supporting members are attached to a working machine, in which the upper supporting member and the upper fixture are coupled by coupling arms and bolted thereto respectively, and the lower supporting member and the lower fixture are coupled by inserting coupling pins into the holes in brackets disposed at the lower supporting member and the lower fixture while the brackets being laid one on the other.

In such an arrangement, loading or unloading work has been very difficult and troublesome because it has been required to bolt the coupling arms above-mentioned and to align the holes of brackets with each other for inserting the coupling pins while a working machine is being lifted up.

SUMMARY OF THE INVENTION

It is an object of the present invention to provide a simply constructed apparatus which overcomes defects of the prior art above-mentioned, and which readily loads and unloads a working machine to and from main equipment.

In order to achieve the above-mentioned or other objects, the apparatus in accordance with the present invention which loads and unloads a working machine to and from main equipment comprises:

- main equipment provided with a pair of supporting members respectively at the upper and lower portions thereof;
- a working machine provided at the lower and upper portions thereof with a pair of fixtures which are disposed correspondingly to said pair of supporting members;
- engagement projections disposed at said upper supporting member;
- engagement hooks disposed at said lower supporting member;
- latch arms disposed at said upper fixture and adapted to engage said engagement projections;
- fitting pins disposed at said lower fixture and adapted to engage said engagement hooks;
- wedge means disposed between said upper supporting member and said upper fixture and adapted to separate said upper supporting member from said upper fixture by means of wedging action thereof; and
- fixing means for fixing said wedge means in its wedging position.

In the present invention, loading a working machine to main equipment can be accomplished only by engaging the fitting pins disposed at the working machine lower fixture with the engagement hooks disposed at the main equipment lower supporting member, and by engaging the latch arms with the engagement projections. Thereafter, the upper supporting member is spaced from the upper fixture by using the wedge means so as to impart tension to the latch arms, and the fitting pins are then strongly pressed down to the engagement hooks, thereby to secure the engagement thereof.

The present invention thus employs an arrangement in which engagement can be easily accomplished, such as that of fitting pins with engagement hooks, or of the latch arms with engagement projections. This arrangement therefore may accomplish readily and easily the loading work, avoiding such conventional troublesome work as laying brackets one on the other and inserting coupling pins into the holes defined in the brackets while keeping the pin holes aligned with each other. On the other hand, a working machine may be unloaded from main equipment only by lifting up the working machine with the wedge means loosened and the latch arms removed.

When main equipment is loaded with a rotatable working machine provided with hydraulic means, with the rotation of working machine, the hydraulic hoses disposed between main equipment and a working machine may often be rubbed by each other thereby to be worn away, or be striken by other matters thereby to be broken. In order to avoid such troubles, the present invention provides a hose bundle frame rotatable around an axis approximately aligned with the rotary axis of said working machine, thereby to reduce the possibility of wear or breakdown of the hydraulic hoses.

BRIEF DESCRIPTION OF THE DRAWINGS

The above and other objects and advantages of the present invention will be cleared in the following detailed description referring to the accompanied drawings, in which.

DETAILED DESCRIPTION OF PREFERRED EMBODIMENTS

Figure 1:
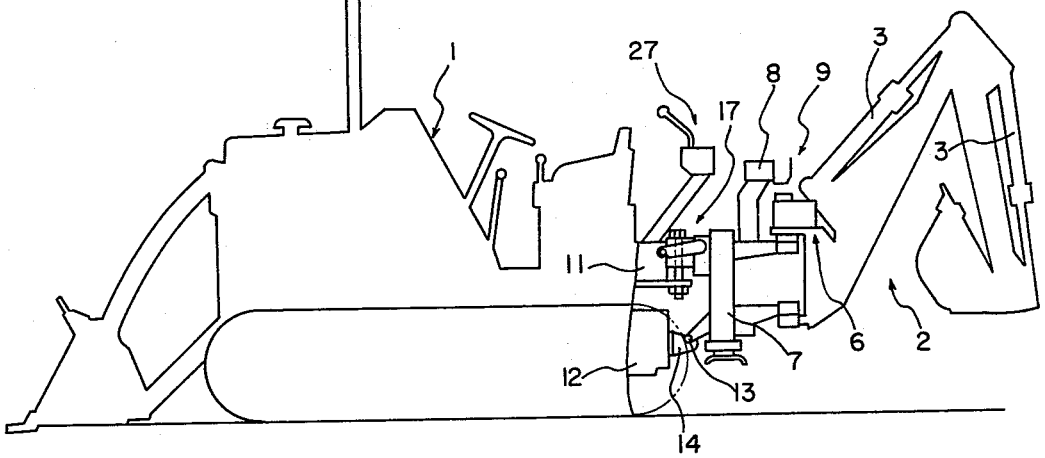
FIG. 1 is a side view of construction equipment in which is applied an apparatus in accordance with the present invention for loading and unloading a working machine to and from main equipment.
Figure 2:
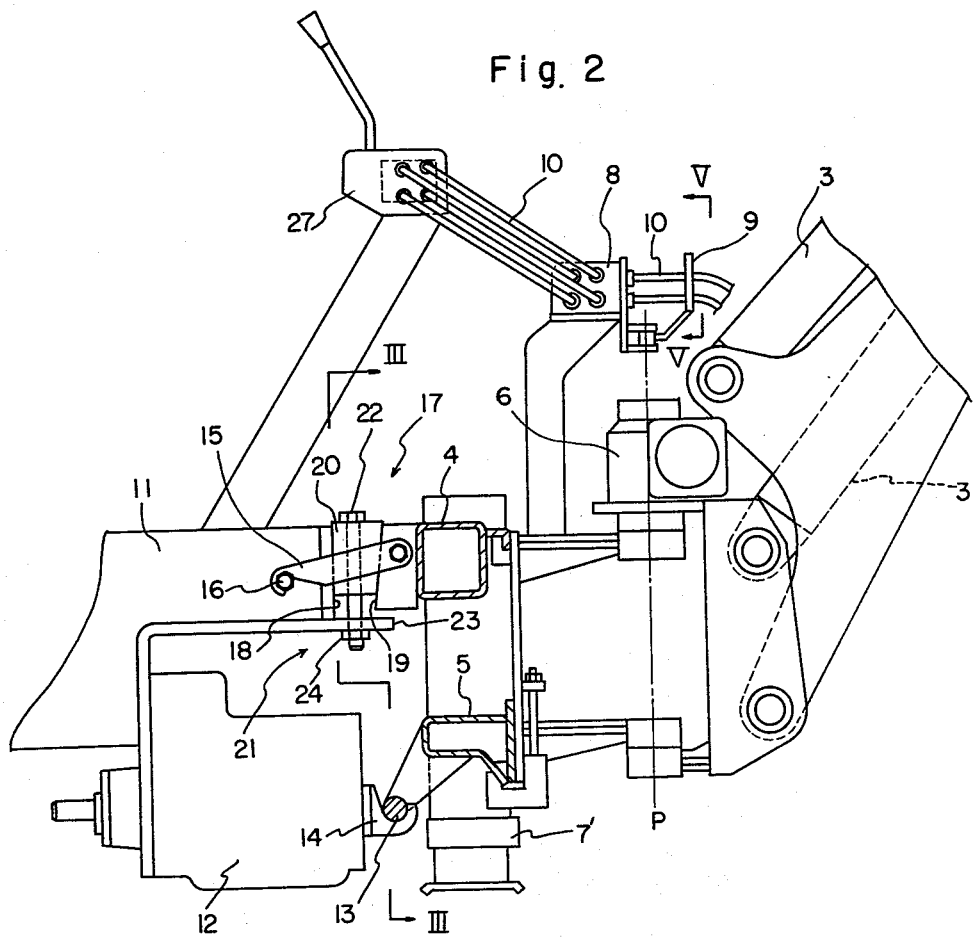
FIG. 2 is a side elevational view of the main part of FIG. 1, with portions broken away.
Figure 3:
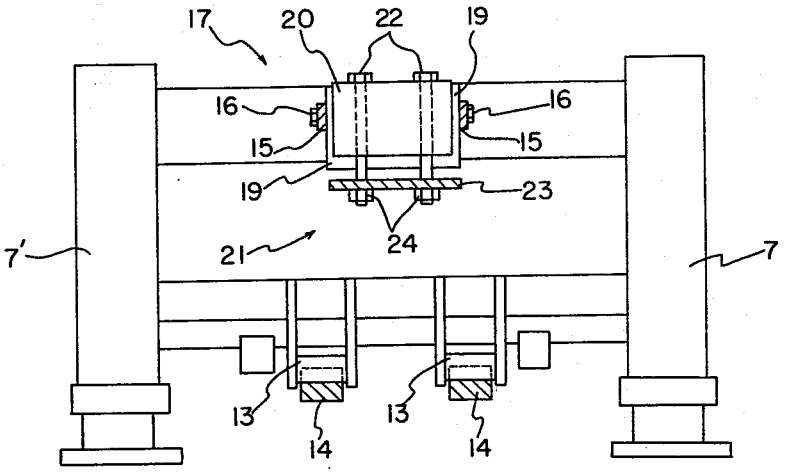
FIG. 3 is a sectional view taken along with the line III—III in FIG. 2.
Figure 4:
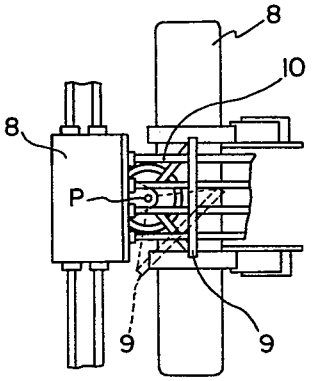
FIG. 4 is a plan view of the main part of FIG. 2.

Preferred embodiments of the present invention will be now described in detail together with the accompanied drawings.

In construction equipment, a working machine 2 is mounted to main equipment 1. The working machine 2 is provided with hydraulic cylinders, as hydraulic means 3, each operating a boom, an arm and an excavator, and being driven by a hydraulic pump disposed at the main equipment 1.

The working machine is further provided with upper and lower fixtures 4. These fixtures are disposed rotatably around the longitudinal axis P and is adapted to rotate around the axis P by means of rotatably driving means 6 comprising a hydraulic motor. The upper and lower fixtures 4 and 5 are integrally arranged by a coupling plate, at the both sides of which a pair of outriggers 7 and 7' to be hydraulically driven are disposed.

Figure 5:
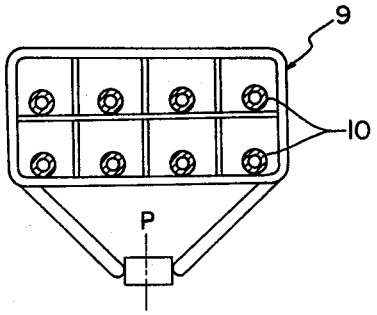
FIG. 5 is a sectional view taken along with the line V—V in FIG. 2.
Figure 6:
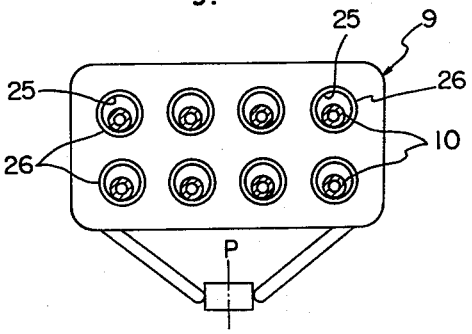
FIG. 6 is a side view of a hose bundle frame in another form.

A hose joint 8 is extended from the upper fixture 4. A hose bundle frame 9 extended from the hose joint 8 is disposed rotatably around an axis approximately aligned with the longitudinal axis P. As clearly shown in FIG. 5, this hose bundle frame 9 is made in the lattice form so that each of hydraulic hoses 10 passes therethrough and is supported thereby. Another form of the hose bundle frame 9 may be embodied as shown in FIG. 6, in which the hydraulic hoses 10 pass through small circular holes 25, around which cylindrical guide members 26 are disposed for guiding each of hydraulic hoses 10. In this arrangement, even if a working machine 2 is rotated around the longitudinal axis P, the hydraulic hoses 10 disposed between the main equipment 1 and the working machine 2 may be guided to the hose bundle frame 9 rotatable around the axis approximately aligned with the longitudinal axis P, thereby not to be rubbed by or contacted with each other. In addition to the above, the hydraulic hoses are all collected together in the hose bundle frame 9, thereby to reduce a possibility of other matters to strike these hydraulic hoses 10, thus preventing damages thereto.

Main equipment 1 is provided with an upper supporting member 11 in a position corresponding to the upper fixture 4 of the working machine 2, and with a lower supporting member 12 in a position corresponding to the lower fixture 5.

Fitting pins 13 are integrally secured to the lower fixture 5 through the intermediary of supporting brackets. Engagement hooks 14 for receiving fitting pins 13 are attached to the lower supporting member 12 of main equipment 1.

One end of each latch arm 15 is rotatably journalled to the upper fixture 4, and the other end thereof is made in the hook shape. Engagement projections 16 are disposed at the upper supporting member 11 in such a position as to engage the hook-shaped ends of the latch arms 15. The engagement projections 16 are formed by bolts which are threaded into the both sides of the upper supporting member 11 so that each bolt head is slightly spaced therefrom. However, any shaped engagement projections may be used as far as they are formed so as to engage the hook-shaped ends of the latch arms 15.

Wedge means 17 is disposed between the upper supporting member 17 and the fixture 4. The wedge means 17 comprises a vertical supporting surface 18 formed on the part of the upper supporting member 11 opposite to the upper fixture 4, an inclined surface 19 formed on the part of the upper fixture 4 opposite to the upper supporting member 11 in such a way that the lower end of the inclined surface 19 is closer to the upper supporting member 11, and a wedge 20 having surfaces contacting with the both surfaces 18 and 19. When the wedge 20 is downwardly pushed while being contacted with both surfaces 18 and 19, the upper supporting member 11 and the upper fixture 4 are adapted to be separated from each other because the surface 19 is inclined.

Fixing means 21 is disposed for fixing wedge means 17, and comprises bolts 22 inserted into holes defined in wedge 20, a supporting plate 23 extended from the upper supporting member 11, and nuts 24 to be threadedly mounted to the bolts 22.

For loading a working machine 2 to the main equipment 1, the fitting pins 13 are firstly engaged with the engagement hooks 14 from the above, the upper fixture 4 is then approached to the upper supporting member 11, and the latch arms 15 are rotated so as to engage the engagement projections 16. Then, from the above, the wedge 20 is inserted between the upper supporting member 11 and the upper fixture 4 and pushed down in a suitable way. By this wedging action, the upper fixture 4 is spaced from the upper supporting member 11 with the fitting pins 13 as rotating center. At this time, the latch arms 15 are subjected to tension and the fitting pins 13 are contact-pressed to the engagement hooks.

The working machine 2 is thus securely mounted to the main equipment 1, after which the bolts 22 of the fixing means 21 are inserted into the wedge 20 and the nuts 24 are fitted so that the wedge means 17 is not loosened.

Unloading of the working machine 2 from the main equipment 1 may be easily accomplished in the reverse procedures.

A controlling gear 27 is attached to the main equipment 1 for operating hydraulic means 3 and rotatably driving means 6.

Detailed description on the working machine 2 is omitted herein, but this is of the well-known buckets operating type. It will be evident that any working machine having any function can be applied to the present invention.

What we claim is:

1. An improved apparatus for loading and unloading a working machine to and from main equipment, comprising:

main equipment (1) provided with a pair of upper and lower supporting members (11) and (12);

a hydraulically operated working machine (2) provided wth a pair of upper and lower fixtures (4) and (5) in a position corresponding to said upper and lower supporting members (11) and (12);

engagement projections (16) disposed at said upper supporting member (11);

engagement hooks (14) disposed at said lower supporting member (12);

latch arms (15) disposed at said upper fixture (4) and adapted to engage said engagement projections (16);

fitting pins (13) disposed at said lower fixture (5) and adapted to engage said engagement hooks (14);

said improvement comprising:

a wedge assembly means employing a slidably disposed member formed to move within a predefined spaced formed between a support member having a vertically oriented end surface and an upper fixture having an inclined end surface; a support plate disposed below said support member and upper fixture extending beneath said pre-defined space for defining the extent of downward travel of said slidably disposed member; fastening means in working relationship with said slidably disposed member, for defining the extent of vertical travel within said predefined space, said fastening means being formed to co-act with said support member; latch means pivotally affixed to said upper fixture; projection means projecting from said support member adapted to engage a working end of said latch means, whereby downward movement of said slidably disposed member urges said latch means to be placed into tension in response to the respective movement of said support member and said upper fixture.

2. An improved apparatus as set forth in claim 1, said improvement comprising:

a plurality of hydraulic hoses (10) to compressingly supply oil from said main equipment (1) to said working machine (2);

rotatably driving means (6) disposed between said upper & lower fixtures (4) & (5) and said working machine (2) for rotating said working machine (2) around a longitudinal axis (P); and a hose bundle frame (9) disposed at said upper fixture (4) and arranged rotatably around an axis approximately aligned with said longitudinal axis (P), said plurality of hydraulic hoses (10) passing within said hose bundle frame (9).

3. An improved apparatus as set forth in claim 1, further comprising:

a controlling gear (27) disposed extendedly from said upper supporting member (11) for operating said working machine (2); and a hose joint (8) extended from said upper fixture (4), said controlling gear (27) and said hose joint (8) being coupled by hydraulic hoses (10).

4. An apparatus as set forth in claim 3 wherein a hose bundle frame (9) is attached to said hose joint (8).

* * * * *